US008709178B2

(12) United States Patent
Takahashi et al.

(10) Patent No.: US 8,709,178 B2
(45) Date of Patent: Apr. 29, 2014

(54) TITANIUM MATERIAL FOR HOT ROLLING AND METHOD OF PRODUCING THE SAME

(75) Inventors: Kazuhiro Takahashi, Tokyo (JP); Tomonori Kunieda, Tokyo (JP); Kenichi Mori, Tokyo (JP); Hiroaki Otsuka, Tokyo (JP); Hideki Fujii, Tokyo (JP); Yoshimasa Miyazaki, Tokyo (JP); Takashi Oda, Chigasaki (JP); Hisamune Tanaka, Chigasaki (JP); Osamu Tada, Chigasaki (JP); Norio Yamamoto, Chigasaki (JP)

(73) Assignees: Nippon Steel & Sumitomo Metal Corporation, Tokyo (JP); Toho Titanium Co., Ltd., Kanagawa (JP)

( * ) Notice: Subject to any disclaimer, the term of this patent is extended or adjusted under 35 U.S.C. 154(b) by 326 days.

(21) Appl. No.: 13/138,358

(22) PCT Filed: Feb. 8, 2010

(86) PCT No.: PCT/JP2010/052129
§ 371 (c)(1),
(2), (4) Date: Aug. 5, 2011

(87) PCT Pub. No.: WO2010/090352
PCT Pub. Date: Aug. 12, 2010

(65) Prior Publication Data

US 2011/0318597 A1 Dec. 29, 2011

(30) Foreign Application Priority Data

Feb. 9, 2009 (JP) ..... 2009-026923

(51) Int. Cl.
*C22C 14/00* (2006.01)

(52) U.S. Cl.
USPC ..... 148/421; 420/417

(58) Field of Classification Search
USPC ..... 148/421; 420/417–421
See application file for complete search history.

(56) References Cited

U.S. PATENT DOCUMENTS

2007/0084530 A1* 4/2007 Boehlert ..... 148/670

FOREIGN PATENT DOCUMENTS

| | | |
|---|---|---|
| JP | 62-214801 | 9/1987 |
| JP | 1-156456 | 6/1989 |
| JP | 2004-167517 | 6/2004 |

OTHER PUBLICATIONS

International Search Report dated Apr. 27, 2010 issued in corresponding PCT Application No. PCT/JP2010/052129.

* cited by examiner

*Primary Examiner* — Jesee Roe
(74) *Attorney, Agent, or Firm* — Kenyon & Kenyon LLP

(57) ABSTRACT

The present invention provides a titanium material for hot rolling which enables reduction of defects on the surface (in the case of a flat material or strip coil, including not only the flat surfaces but also the side surfaces and edges) due to hot rolling. The titanium material for hot rolling has dimples imparted by cold plastic deformation whose mean value of the heights (Wc) of the undulation profile elements is 0.2 to 1.5 mm and mean value of the lengths (WSm) thereof is 3 to 15 mm. The invention also provides a method of producing the titanium material and a method of hot rolling the titanium material.

6 Claims, 3 Drawing Sheets

TITANIUM MATERIAL FOR HOT ROLLING AND METHOD OF PRODUCING THE SAME

This application is a national stage application of International Application No. PCT/JP2010/052129, filed Feb. 8, 2010, which claims priority to JP 2009-0026923, filed on Feb. 9, 2009, which is incorporated by reference in its entirety.

FIELD OF THE INVENTION

This invention relates to a titanium material for hot rolling that enables reduction of defects occurring on the surface (in the case of a flat material or strip coil, the sheet surfaces, side surfaces and edges) owing to the hot rolling, and a method of producing the same, particularly to a titanium material for hot rolling enabling omission of a breakdown process for hot blooming or forging a produced titanium material (ingot), and a method of producing the same.

BACKGROUND ART

The ordinary method of producing a titanium material is explained in the following. First, the method starts with an ingot obtained by solidifying titanium melted by the consumable electrode arc melting method or electron beam melting method, and the ingot is broken down by blooming, rolling or other hot-working process to form a slab, billet or other material for hot rolling. The material for hot rolling is hot rolled to process the slab into a flat material (plate or sheet) or the billet into a bar or rod. The hot-rolled plate, sheet, bar or rod is annealed and/or descaled into a product as is or is made into the final product by cold rolling, cold drawing or other cold-working process and annealing. Note that although surface defects are removed by the descaling after hot rolling, the surface must be removed deeper in proportion as the surface defects are deeper, so that yield naturally declines.

On the other hand, in the electron beam melting method or plasma arc melting method in which melting is done at a location apart from the mold and the molten titanium is poured into the mold, the freedom of mold shape is high, which makes use of a rectangular or cylindrical mold possible. In the case of producing flat material from a rectangular ingot, or in the case of producing bar or rod from a cylindrical ingot, with consideration to the point of the ingot shape, it becomes possible to omit the aforesaid breakdown process, thus lowering production cost.

However, the solidified structure of an industrially utilized large ingot is composed of coarse crystal grains of up to several tens of mm, and when directly hot rolled without passing through a breakdown process experiences uneven deformation owing to the coarse crystal grains, with growth of large surface defects sometimes occurring. As a result, yield declines considerably during, for example, the descaling for removal of surface defects after hot rolling, and product inspection.

Further, when the flat material or strip coil is hot rolled, large wrinkles caused by the coarse solidified structure occur not only on the sheet surface but also at the side surfaces and corners, and these wrinkles wrap around to the sheet surface side to become surface defects called seam defects and develop into edge cracks and the like.

Also during rolling of bar or rod, surface defects occur owing to the formation of wrinkles on the free surface portions and the flash not in contact with the rolls, just as on the side surfaces of a flat material of strip coil during hot rolling. In the aforesaid ordinary production method, the ingot is broken down under heating and formed into a slab or billet of a size that can be hot rolled. However, depending on the amount of hot working and/or the working method during the breakdown, the amount of deformation of the portion constrained by the frictional resistance at the contact region with the working tool is small, so that a so-called dead metal zone occurs. Even if breakdown is conducted, the deformation of this dead metal zone is small and the coarse solidified structure of the ingot remains, so that, similarly to the above, surface defects like those mentioned above sometimes occur when the flat material, bar or rod is thereafter hot rolled.

A need is therefore felt for a titanium material for hot rolling by which the coarse solidified structure of the ingot, or the remainder thereof, does not develop into harmful surface defects in the ensuing hot rolling process.

Patent Document 1 proposes a method wherein, in the case of directly hot-working an ingot of titanium material, strain is imparted to the surface layer to refine the crystal grains near the surface, the surface is then recrystallized to a depth of 2 mm or greater by heating to the recrystallization temperature or higher, and hot working is then conducted. As the means for imparting strain can be mentioned forging (pressing), roll reduction, shot blasting and the like.

Although Patent Document 1 cites shot blasting as the means for imparting strain, the depth of strain formed by ordinary shot blasting is on the order of 300 to 500 μm or less, which is very small relative to the coarse solidified structure of several tens of mm, and, as explained later, the surface defects are by no means suppressed.

In order to form a deep recrystallization layer, it is substantially necessary in the method set out in Patent Document 1 to impart strain to a deep level by forging or roll reduction. However, although forging or roll reduction using ordinary tools forms a deep recrystallization layer, cases occur in which, as explained later, surface defects are not suppressed but, to the contrary, the incidence of surface defects increases.

PRIOR ART REFERENCES

Patent Documents

Patent Document 1 Unexamined Patent Publication (Kokai) No. 01-156456

SUMMARY OF THE INVENTION

Problem to be Solved by the Invention

As set out above, a problem exists of the coarse solidified structure of the material for hot rolling or the remainder thereof causing occurrence of surface defects in the ensuing hot-rolling process. The present invention has as its object to provide a titanium material for hot rolling that enables reduction of defects occurring on the surface (in the case of a flat material or strip coil, including not only the flat surfaces but also the side surfaces and edges) owing to the hot rolling, and a method of producing the same, particularly to a titanium material for hot rolling enabling omission of an ingot breakdown process, and a method of producing the same.

Means for Solving the Problem

The gist of the invention for achieving the aforesaid object is as follows.

(1) A titanium material for hot rolling that is a material composed of titanium for hot rolling into a flat material, bar or rod, which is a titanium material for hot rolling characterized in that its surface has dimples imparted by cold plastic deformation whose mean value of the heights (Wc) of the undulation profile elements is 0.2 to 1.5 mm and mean value of the lengths (WSm) thereof is 3 to 15 mm.

(2) A titanium material for hot rolling set out in (1), characterized in that the titanium material for hot rolling is a rectangular or cylindrical ingot.

(3) A titanium material for hot rolling set out in (1) or (2), characterized in that the titanium material for hot rolling is made of commercially pure titanium.

A method of producing the titanium material for hot rolling set out in (1) or (2), characterized in that the surface of the titanium material is plastically deformed by cold pounding with a steel tool having a tip shape of a radius of curvature of 3 to 30 mm (3 to 30 R).

(5) A method of producing the titanium material for hot rolling set out in (1) or (2), characterized in that the surface of the titanium material is plastically deformed by cold pounding with a steel sphere of a radius of 3 to 30 mm (3 to 30 R).

(6) A method of hot-rolling a titanium material for hot rolling characterized in that among the titanium materials for hot rolling set out in (2), one of slab shape produced in an electron beam melting furnace is fed into a hot rolling mill after heating and hot rolled into a strip coil.

The "mean value of the heights (Wc) of the undulation profile elements" and "mean value of the lengths (WSm) thereof" stated here with regard to the present invention are defined to mean surface property parameters set forth in JIS B0601.

Further, the flat material, bar or rod includes one wound into coil form after the material for hot rolling is hot rolled into flat material, bar or rod.

Note that when the material for hot rolling into flat material, bar or rod is a rectangular or cylindrical ingot in the state as produced in the manner of (2) and casted (ingot of a slab or billet shape enabling hot rolling as it is), it is applied in the method of invention (4) or (5) after removing pits, bumps and other defects on the casting surface by machining or other treatment, or when the casting surface is smooth and in good condition, such aforesaid treatment is omitted.

Further, in the case of a material for hot rolling passed through a blooming or other breakdown process, it is preferable to apply the method of invention (4) or (5) after removing scale and/or defects by machining or other treatment, but it is also acceptable to remove scale and the like by pickling or the like after applying the method of invention (4) or (5) following breakdown.

Note that by rectangular ingot in the present invention is meant one whose cross-sectional shape is rectangular in all of the ingot longitudinal direction, width direction and height direction.

Effect of the Invention

According to the present invention, there can be provided a titanium material for hot rolling which enables reduction of surface defects (in the case of a flat material or strip coil, including not only the flat surfaces but also the side surfaces and edges) caused by the hot rolling owing to the coarse solidified structure of the material for hot rolling or the remainder thereof, and particularly enables omission of an ingot breakdown process, and a method of producing the same, whereby the industrial effect is immeasurable.

BRIEF DESCRIPTION OF THE DRAWING

FIG. 1(*b*) is a diagram showing an example of a steel tool having a radius of 3 to 30 mm (3 to 30 R).

FIG. 2(*b*) is a figure showing the cross-sectional structure of a surface layer after imparting prescribed plastic deformation to the surface of a titanium material for hot rolling using a tool of impact-resistant tool alloy shown in FIG. 1 and further subjecting it to heat treatment.

FIG. 3(*b*) is a figure showing the surface of a titanium material for hot rolling after plastically deforming it by ordinary shot blasting and further subjecting it to heat treatment.

FIG. 4(*b*) is a diagram showing an example of a tool having a corner R portion used in cold pressing or cold rolling.

FIG. 5(*b*) is a figure showing the cross-sectional structure of a surface layer after plastically deforming it by cold pressing with a roll and further subjecting it to heat treatment.

BEST MODE FOR CARRYING OUT THE INVENTION

In the following, embodiments of the present invention are explained using the drawings.

From the viewpoint of reducing surface defects caused by hot rolling, the present inventors carried out an assiduous study with respect to a method for rendering harmless the coarse solidified structure of an ingot, whose crystal grains may reach up to several tens of mm, and also the effects of said solidified structure remaining after breakdown, and further with respect to a titanium material for hot rolling to which the same is applied, whereby the following knowledge was acquired and the present invention achieved.

As a method for refining a coarse solidified structure or eliminating regions where the effects of the solidified structure remain, it is conceivable to impart strain to the surface layer portion and thereafter perform recrystallization by a prescribed heat treatment such as heating during hot rolling.

Figure 1A:
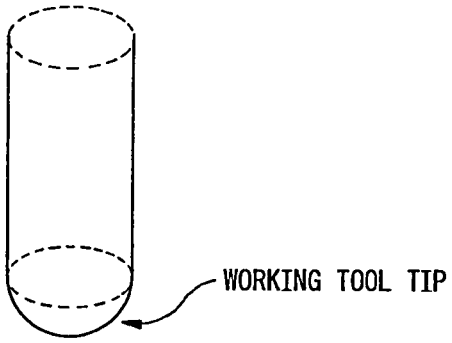
FIG. 1(*a*) is a diagram showing an example of a steel tool having a tip shape of a radius of curvature of 3 to 30 mm (3 to 30 R).
Figure 1B:
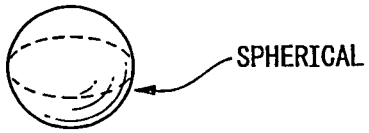

The present invention is a method of imparting strain enabling suppression of surface defects occurring owing to hot rolling, and a method wherein a steel tool such as shown in FIG. 1 having a tip shape of a radius of curvature of 3 to 30 mm (3 to 30 R)(FIG. 1(*a*)) or steel sphere of a radius of 3 to 30 mm (3 to 30 R) (FIG. 1(*b*)) is used to cold-pound the surface of the titanium material for hot rolling to form dimples by prescribed plastic deformation. It was found that this method can markedly suppress surface defects during hot rolling.

Figure 2A:
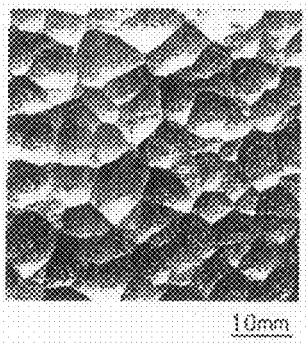
FIG. 2(*a*) is a figure showing the surface state after imparting prescribed plastic deformation to the surface of a titanium material for hot rolling using a tool of impact-resistant tool alloy shown in FIG. 1.
Figure 2B:
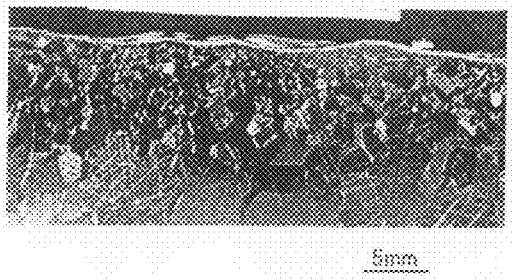

FIG. 2(*a*) and FIG. 2(*b*) respectively show the surface after the surface of a titanium material for hot rolling was imparted with prescribed plastic deformation using the tool of impact-resistant tool alloy shown in FIG. 1(*a*) or FIG. 1(*b*) (the aforesaid steel tool or steel sphere) and the cross-sectional structure of the surface layer after further subjecting it to heat treatment equivalent to hot-roll heating. Note that FIG. 2(*a*) and FIG. 2(*b*) are examples using a material shaped like a slab of JIS type 2 commercially pure titanium (JIS H 4600).

As seen in FIG. 2(*a*), the surface of the material for hot rolling of the present invention is formed with dimples by surface pits and bumps and is different from the conventional surface obtained by plastic deformation by cold pressing or cold rolling using the roll or tool with corner R portion discussed later. The cold-pressed surface has depressions where the corner R was transferred linearly in the longitudinal direction of the tool (see FIG. 4(*a*), FIG. 4(*b*), FIG. 5(*a*) and FIG. 5(*b*)), while the cold-rolled surface is smooth.

Owing to the strain imparted by such plastic deformation that forms the dimples of FIG. 2(*a*), the surface layer portion is recrystallized during the heating by the hot rolling and, as shown in FIG. 2(*b*), an approximately 6 mm thick recrystallized layer is formed. Hot rolling is conducted in such structural condition.

By this method of the present invention, surface defects after hot rolling become very slight and are inhibited to a level that is no problem. On the other hand, many coarse surface defects of a length of 20 mm or greater occur with an as-cast coarse solidified structure not utilizing the present invention.

There was no difference in post-hot-rolling surface defect suppressing effect between the case where the tool for applying plastic deformation to the surface of the material for hot rolling was shaped as a pin whose tip shape in FIG. 1(*a*) had a radius of curvature of 3 to 30 mm (3 to 30 R) and the case where it was a steel sphere of a radius of 3 to 30 mm (3 to 30 R). From this result, the present invention calls for the plastic deformation to be imparted to the surface of the material for hot rolling using a steel tool whose tip shape is of a radius of curvature of 3 to 30 mm (3 to 30 R) or a steel sphere of a radius of 3 to 30 mm (3 to 30 R). Note that in the present invention the depth of the surface dimples is 0.2 to 1.5 mm, and the recrystallization layer after heat treatment is formed to 3 mm or greater. A tool whose radius of curvature or radius is 7 to 20 mm (7 to 20 R) is more preferable because surface defects can be further and consistently minimized.

In contrast, when the tip shape of the steel tool has a radius of curvature smaller than 3 mm (3 R), the amount of strain that can be imparted and the range thereof are small, so that surface defects are sometimes not adequately suppressed, and moreover, the dimple ridges assume a steep shape and therefore are overlaid by the hot rolling to develop into surface defects. On the other hand, when R becomes large and the radius of curvature exceeds 30 mm (30 R), the contact surface with the material for hot rolling during plastic deformation becomes flat, so that the effect of suppressing surface defects after hot rolling varies by region and sometimes cannot be adequately realized. Further, also in the case of the steel sphere, when its radius is less than 3 R (3 mm radius) or greater than 30 R (30 mm radius), appropriate effect cannot be obtained, as with the aforesaid tip shape effect.

Even if the temperature at which the surface is plastically deformed is a somewhat high 300 to 400° C., the accumulated strain is not readily removed at a temperature in this region, so that the prescribed plastic deformation is possible if the temperature range is 300 to 400° C. or lower. It is likewise possible even at or below room temperature. However, the present invention is preferable carried out under cold condition in view of workability and/or auxiliary equipment (temperature control).

On the other hand, strain can also be imparted by heretofore available ordinary shot blasting (shot diameter of around 0.5 to 1 mm), cold rolling, or cold pressing (forging) with a roll or a tool with a corner portion of a radius of curvature of 10 to 20 mm (10 to 20 R).

Figure 3A:
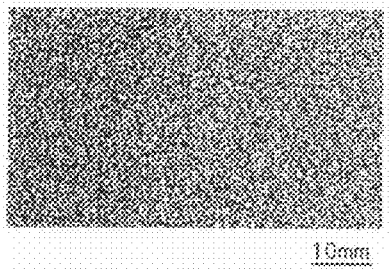
FIG. 3(*a*) is a figure showing the surface of a titanium material for hot rolling plastically deformed by performing ordinary shot blasting.
Figure 3B:
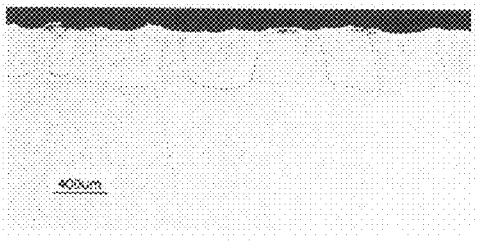

However, the amount of strain applied by ordinary shot blasting is small due to the small shot diameter of 0.5 to 1 mm, so that, as shown in FIG. 3, the recrystallized layer after heat treatment is shallow, at around 0.4 mm (400 μm), which made it impossible to suppress surface defects during hot rolling.

Figure 4A:
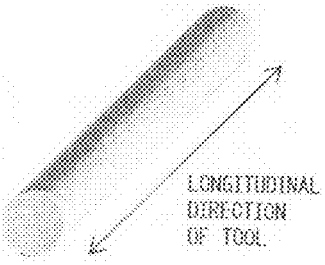
FIG. 4(*a*) is a diagram showing an example of a roll used in cold pressing or cold rolling.
Figure 4B:
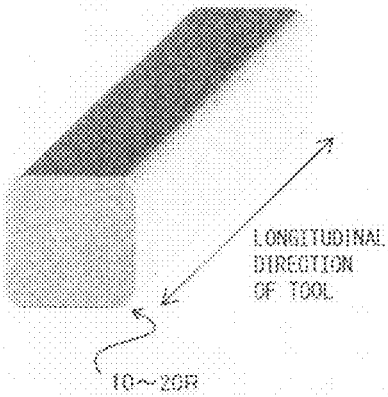
Figure 5A:
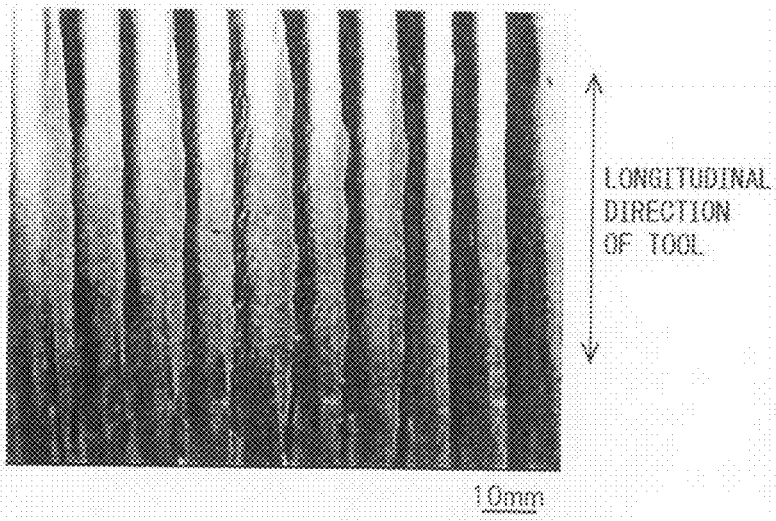
FIG. 5 (*a*) is a figure showing the surface of a titanium material for hot rolling plastically deformed after cold pressing with a roll.
Figure 5B:
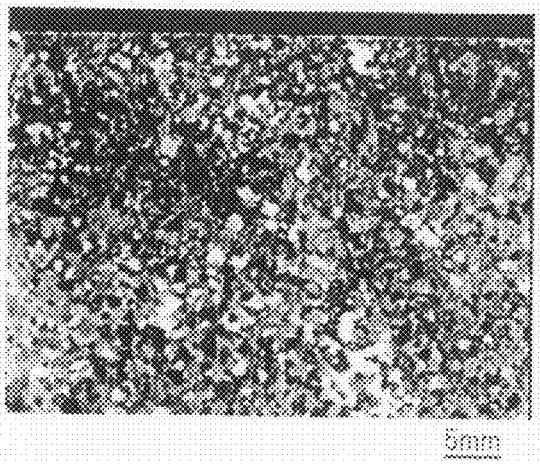

In the case of imparting strain by cold pressing or cold rolling using, as shown in FIG. 4(*a*) or FIG. 4(*b*), a roll (FIG. 4(*a*)) or tool having a corner R portion (FIG. 4(*b*)), a recrystallization layer after heat treatment of up to a depth of 30 mm or greater from the surface could be formed, as shown in FIG. 5(*b*). However, the surface defects after hot rolling, although shrinking to around 3 to 10 mm, were still at a harmful level, and, moreover, increased greatly in incidence of occurrence.

As the cold rolling or cold pressing using a tool shown in FIG. 4(*a*) or FIG. 4(*b*) is conducted under reduction from one direction, a flat surface is formed in the case of cold rolling and a surface having depressions, such as in FIG. 5(*a*), where the corner R is transferred linearly in the longitudinal direction of the tool is formed in the case of cold pressing. This point is much different from in the present invention, which forms dimples by plastic deformation with a spherical portion. Note that, respectively, FIG. 5 (*a*) shows a surface after cold pressing with a roll of a radius of curvature of 15 mm (15 R), and FIG. 5(*b*) shows the cross-sectional structure of the surface layer subjected to heat treatment after the surface was made smooth by machining.

In the case where the material for hot rolling is slab shaped, then with a roll or the conventional tool having a corner R portion, plastic deformation in a fixed direction (slab thickness direction) predominates with deformation of the constrained slab surface in the longitudinal direction of the tool not being possible because the slab surface is linearly contacted in parallel with the longitudinal direction of the tool (see FIG. 5(*a*)). As a result, randomization of the post-heating recrystallized grains does not progress and coarse colonies of the same crystal orientation occur, which is thought to be due to the strong residual effects of the initial coarse solidified structure. Further, the slab side surfaces that do not contact the roll or tool may experience pronounce bulging or the like and thus assume a shape inappropriate for a material to be hot rolled.

In contrast, in the method of the present invention, the surface is greatly plastic deformed by the spherical part, so that the plastically deformed region expands not only in the thickness direction but also radially from the contact portion of the tool spherical surface. In addition, this expansion of the plastically deformed region is overlaid between adjacent dimples. Therefore, unlike in the case of reduction with a roll, the surface layer portion comes to receive plastic deformation from various directions. It is thought that randomization of the crystal orientation is promoted as a result. This point is thought to be why a different result is exhibited from in the case of reduction from a single direction with a roll or the like as in the aforesaid FIG. 4.

Next, a more detailed explanation will be given regarding the shape of the dimples formed on the surface of the material for hot rolling by the method of the present invention set out in the foregoing.

The depth (height) and spacing of the pits/bumps of the formed dimples reflect the amount of the plastic deformation received by the surface and the direction thereof. Among the surface property parameters set forth in JIS B0601, the mean height (Wc) of the undulation profile elements and the mean length (WSm) of the undulation profile elements can be used as values indicating the dimple depth and dimple spacing. Post-hot-rolling surface defects in the dimpled surface formed by cold plastic deformation can be adequately suppressed in the ranges of Wc of 0.2 to 1.5 mm and WSm of 3 to 15 mm. Therefore, the present invention defines the titanium material for hot rolling as characterized in having dimples imparted by cold plastic deformation of a Wc of 0.2 to 1.5 mm and a WSm of 3 to 15 mm.

Preferably, the ranges are defined as Wc of 0.3 to 1.0 mm and WSm of 4 to 10 mm because this enables surface defects to be further and consistently minimized. In the case of the surface layer formed with dimples in the ranges of the present invention, the recrystallized layer after heat treatment is formed to 3 mm or greater.

As stated earlier, when Wc exceeds 1.5 mm and WSm is less than 3 mm, the pits/ridges of the dimples assume a steep shape and therefore are overlaid by the hot rolling to develop into surface defects. On the other hand, when Wc is less than 0.2 mm and WSm exceeds 15 mm, the amount of strain imparted and the range thereof are small, so that cases in which surface defects are not adequately suppressed and cases in which adequate effect is not obtained in the flat regions may arise The aforesaid values of Wc and WSm are ones obtained by measuring Wc and WSm at multiple locations to make the total number of dimples measured at least 30 or greater and calculating the average thereof. Note that the properties of the dimples of the present invention can also be obtained not only by the shape of the tool used but also by regulating the amount of plastic deformation by the pressure, projection velocity and the like of air.

When the material for hot rolling is slab shaped, the present invention has the same effect also in suppressing wrinkles at the side surfaces and corners. As a result, surface defects at and near the edges of the hot-rolled flat material (strip coil), and also edge cracking by the ensuing cold rolling, can be made extremely slight. Moreover, owing to the suppression of wrinkles, seam defects caused by the side surfaces and/or corner portions wrapping around to the rolled surface side can simultaneously be made slight.

Up to here, explanation was given mainly with regard to hot rolling of flat material, but the same effects can be obtained by the present invention when hot rolling cylindrical billet or ingot into bar or rod, and surface defects of the product can be made very slight, including at the flash portions and free surface portions that do not contact the roll. The material for hot rolling utilizing the present invention markedly suppresses surface defects after hot rolling. Particularly, application of the present invention to a square or cylindrical ingot (with as-cast solidified structure) produces the effect of enabling suppression of surface defects to a non-problematic level during hot rolling of flat material, strip coil, bar or rod even without passage through a breakdown process such as blooming.

The electron beam melting method makes it possible to condense the beam by polarizing the projected electron beam, whereby heat can be easily supplied even to the narrow region between the mold and the molten titanium, thus enabling good control of the casting surface. Further, the freedom of mold cross-sectional shape is high. As a result, a rectangular or cylindrical ingot set out in the present invention (2) of a size that can be subjected to direct hot rolling is preferably produced using an electron beam melting furnace. Further, prior to hot rolling, the surface of the rectangular ingot (slab) produced by an electron beam melting furnace is subjected under cold condition to the plastic deformation of (4) or (5) so as to form the dimpled configuration of the present invention (1). It is thereafter heated for hot rolling. In order to reduce deformation resistance, this heating temperature is preferably set in the range of 800 to 950° C. In addition, in order to inhibit scale occurring during slab heating, the heating temperature is desirably lower than the β transformation point. Note that the rectangular ingot (slab) for hot rolling according to the present invention can be efficiently produced into an approximately 2 to 10 mm strip coil by the aforesaid hot rolling.

Thus, the rectangular ingot (slab) for hot rolling produced in accordance with the present invention exhibits the effects not only of being favorably subjected to hot rolling but also of the titanium flat material produced by the hot rolling being markedly suppressed in surface defects to enable production of sound sheet even when thereafter subjected to cold rolling.

Application of the present invention to a hot-rolling material passed through a breakdown process gives a result extremely reduced in surface defects occurring during hot rolling. As a result, the process of descaling the hot-rolled flat material, bar or rod and the final product yield can be enhanced.

To be specific, the titaniums used in the present invention start with commercially pure titaniums typified by the types 1 to 4 of JIS H 4600, plus ones enhanced in properties such as corrosion resistance and/or high-temperature characteristics by adding to a base of commercially pure titanium relatively small amounts of one or more of Ru, Pd, Ta, Co, Cr, Ni, Cu, Nb, Si and Al, for example, Ti—1% Cu, Ti—1% Cu—0.5% Nb, and types 11 to 23 of JIS H 4600. In addition, α type titanium alloy and α+β type alloy are also usable, with the α+β type alloy corresponding to, for example, JIS H 4600 type 60 (Ti—6% Al—4% V), type 60E, type 61 (Ti—3% Al—2.5% V), type 61F, or a Ti—Fe—O three-element system alloy such as Ti—1% Fe—0.36% O. In addition, there are β type titanium alloys typified by Ti—15% V—3% Cr—3% Sn—3% Al, and the like. Note that % in the foregoing is in all cases mass %.

EXAMPLES

Examples 1

The present invention is explained in further detail with respect to examples of materials to be hot rolled into the following flat materials or strip coils.

Table 1 shows, for the case of using JIS type 2 commercially pure titanium (JIS H 4600), the conditions under which the surface of the material for hot rolling was plastically deformed, the properties (Wc, WSm) of the dimples formed by this plastic deformation, and the results of post-hot-rolling surface defect evaluation.

TABLE 1

| | | Pre-hot-roll | | | Evaluation of post-hot-roll surface defects | | | |
|---|---|---|---|---|---|---|---|---|
| | | treatment *Applied to surface (surface to be rolled) Tool used for plastic | Dimple properties of material for hot rolling | | | After 1st nitric-hydrofluoric acid pickling | | |
| Example No. | Type | deformation | Wc (mm) | WSm (mm) | Evaluation | Main surface defect level | Surface defect rate | After 2nd nitric-hydrofluoric acid pickling1 |
| Invention 1 | Pure Ti JIS Type 2 | 3R tip | 0.6 | 3.2 | Good | Approx 1 mm long tiny defects | 5% | Defects on left vanished |
| Invention 2 | Pure Ti JIS Type 2 | 3R tip | 1.5 | 4.8 | Good | Approx 1 mm long tiny defects | 5% | Defects on left vanished |
| Invention 3 | Pure Ti JIS Type 2 | 7R tip | 0.5 | 5.0 | Ex | None | 0% | — |

TABLE 1-continued

| Example No. | Type | Pre-hot-roll treatment *Applied to surface (surface to be rolled) Tool used for plastic deformation | Dimple properties of material for hot rolling Wc (mm) | WSm (mm) | Evaluation of post-hot-roll surface defects: Evaluation | After 1st nitric-hydrofluoric acid pickling: Main surface defect level | Surface defect rate | After 2nd nitric-hydrofluoric acid pickling1 |
|---|---|---|---|---|---|---|---|---|
| Invention 4 | Pure Ti JIS Type 2 | 7R tip | 0.9 | 6.4 | EX | None | 0% | — |
| Invention 5 | Pure Ti JIS Type 2 | 7R steel sphere | 0.4 | 4.2 | EX | None | 0% | — |
| Invention 6 | Pure Ti JIS Type 2 | 12R tip | 0.3 | 5.1 | EX | None | 0% | — |
| Invention 7 | Pure Ti JIS Type 2 | 12R tip | 0.6 | 7.2 | EX | None | 0% | — |
| Invention 8 | Pure Ti JIS Type 2 | 12R tip | 1.0 | 9.2 | EX | None | 0% | — |
| Invention 9 | Pure Ti JIS Type 2 | 12R steel sphere | 0.4 | 5.4 | EX | None | 0% | — |
| Invention 10 | Pure Ti JIS Type 2 | 12R tip | 1.4 | 10.0 | Good | Approx 1 mm long tiny defects | 3% | Defects on left vanished |
| Invention 11 | Pure Ti JIS Type 2 | 20R tip | 0.7 | 9.8 | EX | None | 0% | — |
| Invention 12 | Pure Ti JIS Type 2 | 25R tip | 1.5 | 14.3 | Good | Approx 1 mm long tiny defects | 5% | Defects on left vanished |
| Invention 13 | Pure Ti JIS Type 2 | 30R tip | 0.2 | 6.1 | Good | Approx 1 mm long tiny defects | 3% | Defects on left vanished |
| Invention 14 | Pure Ti JIS Type 2 | 30R tip | 0.8 | 13.2 | Good | Approx 1 mm long tiny defects | 5% | Defects on left vanished |
| Comparative 1 | Pure Ti JIS Type 2 | 1R steel sphere | 0.1 | 1.1 | Poor | 20mm+ long coarse defects | 95% | Most defects on left remained |
| Comparative 2 | Pure Ti JIS Type 2 | 1R steel sphere | 2.9 | 3.2 | Poor | Approx 10~15 mm long large defects | 88% | Most defects on left remained |
| Comparative 3 | Pure Ti JIS Type 2 | 40R tip | 0.1 | 5.8 | Poor | 20 mm+ long coarse defects | 90% | Most defects on left remained |
| Comparative 4 | Pure Ti JIS Type 2 | 40R tip | 0.8 | 18.1 | Poor | Approx 5~10 mm long large defects | 85% | Most defects on left remained |
| Comparative 5 | Pure Ti JIS Type 2 | Cold roll (8% reduction) | — | — | Poor | Approx 5~10 mm long large defects | 80% | Most defects on left remained |
| Comparative 6 | Pure Ti JIS Type 2 | Cold press (15 mm R roll, 10 mm press-in) | — | — | Poor | Approx 5~10 mm long large defects | 85% | Most defects on left remained |
| Comparative 7 | Pure Ti JIS Type 2 | Cold press (15R corner, 10 mm press-in | — | — | Poor | Approx 5~10 mm long large defects | 83% | Most defects on left remained |
| Comparative 8 | Pure Ti JIS Type 2 | Not conducted (as machined) | — | — | Poor | 20mm+ long coarse defects | 100% | Most defects on left remained |

The materials for hot rolling (thickness: approximately 120 mm, width: approximately 150 mm, length: approximately 350 mm) were cut from a large rectangular ingot (with an as-cast coarse solidified structure) and machined. Note that the materials for hot rolling were cut so that they would coincide in the positional relationship of cutting with respect to the ingot and so that their depth location from the surface of the ingot would be substantially the same. The surfaces (surfaces to be rolled) on one side of the materials for hot rolling were subjected to various kinds of cold plastic deformation.

The material for hot rolling was heated for about 2 hours at a temperature lower than the β transformation point and was then hot rolled to a thickness of about 6 mm. This hot-rolled flat material was shot blasted and descaled by nitric-hydrofluoric acid pickling, whereafter the surface defects that occurred were marked and the surface defect incidence rate evaluated. The length of the hot-rolled flat material, except for the unsteady portions at the leading and trailing ends in the rolling direction, was segmented at 150 mm intervals, and the ratio obtained by dividing the number of sections with portions where surface defects were detected by the total number of sections (40 sections) was defined as the surface defect incidence rate. When surface defects were distinctly observed, second nitric-hydrofluoric acid pickling was conducted and the degree of the surface defects was then compared again.

In comparative examples 1 to 8 in Table 1, post-hot-rolling surface defects of a length of about 5 to 15 mm, and further coarse ones of 20 mm or greater, were observed, and the surface defect incidence was very high at 80% or greater. Even if dimples were formed, surface defects were not suppressed in comparative example 1 and comparative example 3, in which the region imparted with strain was shallow due to the small We of 0.1 mm, and in comparative example 4 which had portions where strain was planarly imparted due to the large WSm of 18.1 mm. Further, in comparative example 2, the pits/ridges of the dimples were steep and therefore overlaid by the hot rolling to develop into surface defects.

In contrast, in invention examples 1 to 14, dimples having suitable We and WSm were formed by use of an aforesaid suitable tool, so that any post-hot-rolling surface defects observed were minute, at a length of around 1 mm, and of a level that could be removed by the second nitric-hydrofluoric acid pickling. The surface defect incidence rate after the first nitric-hydrofluoric acid pickling was also 5% or less, which is markedly reduced compared with the comparative examples and a level on a par with the surface defect incidence rate (3 to 5%) similarly evaluated for materials that were broken down. Thus, surface defects were suppressed by the present invention.

Table 2 similarly shows examples for type 1 JIS commercially pure titanium, and Ti—1% Fe-0.36% O (% is mass %) and Ti—3% Al—2.5% V (% is mass %), which are titanium alloys.

Moreover, in Table 1 and Table 2, invention examples 3 to 9, 11, and 15 to 21, whose dimple We and WSm were in the aforesaid preferable ranges, were already free of observed surface defects after the first nitric-hydrofluoric acid pickling, so surface defects were consistently minimized.

Note that materials plastically deformed and heated under the same conditions were prepared and their surface layer cross-sectional structures after heating were observed, with the result that invention examples 1 to 21 were found to be formed with a recrystallization layer of a thickness of 3 mm or greater.

TABLE 2

| | | Pre-hot-roll treatment | | | Evaluation of post-hot-roll surface defects | | | |
|---|---|---|---|---|---|---|---|---|
| | | *Applied to surface (surface to be rolled) Tool used for | Dimple properties of material for hot rolling | | | After 1st nitric-hydrofluoric acid pickling | | After 2nd |
| Example No. | Type | plastic deformation | Wc (mm) | WSm (mm) | Evaluation | Main surface defect level | Surface defect rate | nitric-hydrofluoric acid pickling1 |
| Invention 15 | Pure Ti JIS Type 1 | 7R tip | 0.9 | 6.7 | Ex | None | 0% | — |
| Invention 16 | Pure Ti JIS Type 1 | 12R tip | 0.7 | 7.5 | Ex | None | 0% | — |
| Invention 17 | Pure Ti JIS Type 1 | 20R tip | 0.6 | 9.8 | Ex | None | 0% | — |
| Invention 18 | Ti-1% Fe-0.36% O | 12R tip | 0.5 | 5.9 | EX | None | 0% | — |
| Invention 19 | Ti-1% Fe-0.36% O | 12R tip | 0.8 | 7.8 | EX | None | 0% | — |
| Invention 20 | Ti-3% Al-2.5% V | 12R tip | 0.5 | 5.8 | EX | None | 0% | — |
| Invention 21 | Ti-3% Al-2.5% V | 12R tip | 0.8 | 7.8 | EX | None | 0% | — |
| Comparative 9 | Pure Ti JIS Type 1 | 1R steel sphere | 0.1 | 1.2 | Poor | 20 mm+ long coarse defects | 98% | Most defects on left remained |
| Comparative 10 | Ti-1% Fe-0.36% O | 1R steel sphere | 0.1 | 0.9 | Poor | 20 mm+ long coarse defects | 95% | Most defects on left remained |
| Comparative 11 | Ti-3% Al-2.5% V | 1R steel sphere | 0.1 | 0.8 | Poor | 20 mm+ long coarse defects | 95% | Most defects on left remained |
| Comparative 12 | Pure Ti JIS Type 1 | Cold press (15 mm R roll, 10 mm press-in) | — | — | Poor | Approx 5~10 mm long large defects | 88% | Most defects on left remained |
| Comparative 13 | Ti-1% Fe-0.36% O | Cold press (15 mm R roll, 10 mm press-in) | — | — | Poor | Approx 5~10 mm long large defects | 80% | Most defects on left remained |
| Comparative 14 | Ti-3% Al-2.5% V | Cold press (15 mm R roll, 10 mm press-in) | — | — | Poor | Approx 5~10 mm long large defects | 83% | Most defects on left remained |

As shown by invention examples 15 to 21, effects like those for JIS type 2 commercially pure titanium in Table 1 were obtained also in the case where the type was JIS type 1 commercially pure titanium (invention examples 15 to 17), Ti—1% Fe—0.36% O (invention examples 18 and 19) and Ti—3% Al—2.5% V (invention examples 20 and 21). On the other hand, in comparative examples 9 to 11 that used a 1R (1 mm radius) steel sphere, and in cold-pressed comparative examples 12 to 14, post-hot-rolling surface defects of a length of about 5 to 10 mm, and further coarse ones of 20 mm or greater, were observed, and the surface defect incidence was very high at 80% or greater.

Next, materials for hot rolling (thickness: approximately 120 mm, width: approximately 150 mm, length: approximately 350 mm) were subjected to cold plastic deformation of the side surface sides and the results of edge property evaluation after conducting to as far as cold rolling are shown in Table 3. After conducting hot rolling and descaling in the same way as above, cold rolling up to a thickness of 0.5 mm was performed, and the edge cracking and seam defects thereof were evaluated.

TABLE 3

| Example No. | Type | Pre-hot-roll treatment *Applied to side surfaces Tool used for plastic deformation | Dimple properties of material for hot rolling Wc (mm) | WSm (mm) | Evaluation of edge property after cold rolling to depth of 0.5 mm Eval-uation | Edge crack depth (mm) | Seam defects |
|---|---|---|---|---|---|---|---|
| Invention 22 | Pure Ti JIS Type 1 | 12R tip | 0.7 | 7.5 | Ex | 0.5 mm or less | None |
| Invention 23 | Pure Ti JIS Type 2 | 12R tip | 0.6 | 7.2 | Ex | 0.5 mm or less | None |
| Invention 24 | Pure Ti JIS Type 2 | 20R tip | 0.7 | 9.8 | Ex | 0.5 mm or less | None |
| Comparative 15 | Pure Ti JIS Type 1 | Not conducted (as machined) | — | — | Poor | About 2 mm | Present |
| Comparative 16 | Pure Ti JIS Type 2 | Not conducted (as machined) | — | — | Poor | About 2 mm | Present |
| Comparative 17 | Pure Ti JIS Type 2 | Cold press (15 mm R roll, 10 mm press-in) | — | — | Poor | About 2 mm | Present |

In invention examples 22 to 24, edge crack depth was very shallow, at 0.5 mm or less, and no seam defects were observed. On the other hand, in comparative examples 15 to 17, edge cracks of no less than about 2 mm occurred, and seam defects were distinctly observed. Owing to the suppression by the present invention of wrinkles occurring at the side surfaces and corners during hot rolling, the edge properties after hot rolling improved to the same level as a broken-down material.

Next, examples of hot rolling and further cold rolling strip coil will be shown.

A large rectangular ingot (with an as-cast coarse solidified structure) composed of JIS 2 type commercially pure titanium was sliced to a size enabling rolling with a hot rolling mill for steel to fabricate a slab for hot rolling. The surface to be rolled and part of the side surfaces thereof were subjected to plastic deformation using a steel tool having a tip shape of a radius of curvature of 12 mm (12 R) to form dimples with Wc of 0.6 mm and WSm of 7.2 mm. This slab was then hot rolled into a strip coil of a thickness of about 5 mm using a hot rolling mill for steel.

This strip coil was shot blasted and nitric-hydrofluoric acid pickled and then visually observed for surface defects and the like, with the result that no surface defects or seam defects were observed at portions formed with the aforesaid dimples of the present invention, and side surface wrinkles were also found to be very slight. On the other hand, coarse surface defects exceeding 20 mm in length were observed over substantially the full length of portions not formed with the dimples, and seam defects and side surface wrinkles were also conspicuous.

In addition, when this hot-rolled strip coil was cold rolled to a thickness of 0.5 mm and the edge properties compared, edge cracks of a depth of 2 mm or greater were observed at high incidence in the portions where dimples were not formed in the side surfaces, while the edge crack depth was minimal, at 0.5 mm or less, in the side surface portions where the dimples of the present invention were formed.

As set out in the foregoing, the present invention achieves the same effects as in the case of the flat materials shown in Table 1, Table 2 and Table 3 also in flat-material strip coil.

Examples 2

The present invention is explained in further detail in accordance with examples of materials hot rolled into the following bar or rod.

Table 4 shows, for the case of using JIS type 2 commercially pure titanium (JIS H 4600) and the titanium alloys Ti—1% Fe—0.36% O and Ti—3% Al—2.5% V, the conditions under which the surface of the material for hot rolling was plastically deformed, the properties (Wc, WSm) of the dimples formed by this plastic deformation, and the results of post-hot-rolling surface defect evaluation.

TABLE 4

| Example No. | Type | Pre-hot-roll treatment *Applied to all surfaces Tool used for plastic deformation | Dimple properties of material for hot rolling Wc (mm) | WSm (mm) | Evaluation of post-hot-roll surface defects (After shot blasting + nitric-hydrofluoric acid pickling) Evaluation | Main surface defect level | Surface defect rate |
|---|---|---|---|---|---|---|---|
| Invention 25 | Pure Ti JIS Type 2 | 12R tip | 0.6 | 6.9 | Ex | None | 0% |
| Invention 26 | Pure Ti JIS Type 2 | 20R tip | 0.7 | 9.5 | Ex | None | 0% |
| Invention 27 | Ti-1% Fe-0.36% O | 12R tip | 0.5 | 5.6 | Ex | None | 0% |
| Invention 28 | Ti-3% Al-2.5% V | 12R tip | 0.5 | 5.5 | EX | None | 0% |
| Comparative 18 | Pure Ti JIS Type 2 | Not conducted (as machined) | — | — | Poor | 20 mm+ long coarse defects | 100% |
| Comparative 19 | Ti-1% Fe-0.36% O | Not conducted (as machined) | — | — | Poor | 20 mm+ long coarse defects | 98% |
| Comparative 20 | Ti-3%Al-2.5% V | Not conducted (as machined) | — | — | Poor | 20 mm+ long coarse defects | 98% |

The materials for hot rolling (diameter: approximately 90 mm, length: approximately 350 mm) were cut from a large rectangular ingot (with an as-cast coarse solidified structure) and machined.

This material for hot rolling was heated for about 2 hours at a temperature lower than the β transformation point and was then hot rolled to a diameter of about 20 mm. This hot-rolled rod was shot blasted and descaled by nitric-hydrofluoric acid pickling, whereafter the surface defects that occurred were marked and the surface defect incidence rate evaluated. The length of the hot-rolled rod, except for the unsteady portions at the leading and trailing ends in the rolling direction, was segmented at 150-mm intervals, and the ratio obtained by dividing the number of sections with portions where surface defects were detected by the total number of sections (40 sections) was defined as the surface defect incidence rate.

As shown in Table 4, similarly to in the case of a flat material, surface defects were markedly slight in invention examples 25 to 28 as compared with comparative examples 18 to 20.

As explained using examples, namely flat material or strip coil in Examples 1 and bar or rod in Examples 2, it was found that in titanium materials application of the present invention makes it possible to minimize surface defects occurring in ensuing hot rolling even if a process for breaking down the ingot (hot blooming, forging or the like) is omitted.

Application of the present invention to a hot-rolling material passed through a breakdown process minimizes surface defects occurring during hot rolling, so that the ensuing descaling process and final product yield can be further enhanced beyond the status quo level.

The invention claimed is:

1. A titanium material for hot rolling into a flat material, bar or rod, characterized in that its surface has dimples imparted by cold plastic deformation whose mean value of the heights (Wc) of the undulation profile elements is 0.2 to 1.5 mm and mean value of the lengths (WSm) thereof is 3 to 15 mm.

2. The titanium material for hot rolling of claim 1, characterized in that the titanium material for hot rolling is a rectangular or cylindrical ingot.

3. A method of hot-rolling the titanium materials for hot rolling of claim 2, characterized in that a slab shape produced in an electron beam melting furnace is fed into a hot rolling mill after heating and hot rolled into a strip coil.

4. The titanium material for hot rolling of claim 1 or 2, characterized in that the titanium material for hot rolling is made of commercially pure titanium.

5. A method of producing the titanium material for hot rolling of claim 1 or 2, characterized in that the surface of the titanium material is plastically deformed by cold pounding with a steel tool having a tip shape of a radius of curvature of 3 to 30 mm.

6. A method of producing the titanium material for hot rolling of claim 1 or 2, characterized in that the surface of the titanium material is plastically deformed by cold pounding with a steel sphere of a radius of 3 to 30 mm.

* * * * *

UNITED STATES PATENT AND TRADEMARK OFFICE

CERTIFICATE OF CORRECTION

PATENT NO. : 8,709,178 B2
APPLICATION NO. : 13/138358
DATED : April 29, 2014
INVENTOR(S) : Takahashi et al.

It is certified that error appears in the above-identified patent and that said Letters Patent is hereby corrected as shown below:

In the Specification

Column 3, line 9, change "A method" to -- (4) A method --;

Column 7, line 11, change "may arise" to -- may arise. --;

Column 10, line 56, change "We" to -- Wc --;

Column 10, line 63, change "We" to -- Wc --;

Column 12, line 2, change "We" to -- Wc --.

Signed and Sealed this
Eleventh Day of November, 2014

Michelle K. Lee

Michelle K. Lee
*Deputy Director of the United States Patent and Trademark Office*